United States Patent [19]

Brock

[11] 4,005,979

[45] Feb. 1, 1977

[54] MULTISTAGE PROGRESSIVE DRYING METHOD

[75] Inventor: James Donald Brock, Chattanooga, Tenn.

[73] Assignee: Astec Industries, Inc., Chattanooga, Tenn.

[22] Filed: July 3, 1975

[21] Appl. No.: 593,102

Related U.S. Application Data

[62] Division of Ser. No. 453,839, March 22, 1974, Pat. No. 3,923,449.

[52] U.S. Cl. ..... 432/8; 432/144; 34/23

[51] Int. Cl.[2] ..... F27B 9/28

[58] Field of Search ..... 432/8, 29, 59, 128, 432/144, 152, 222, 72; 32/18, 23, 35, 26, 86, 155, 209, 210, 212, 218, 219, 223, 234, 227, 72

[56] References Cited

UNITED STATES PATENTS

| | | | |
|---|---|---|---|
| 1,798,718 | 3/1931 | Brown | 34/213 |
| 1,860,887 | 5/1932 | Buysse | 432/144 |
| 2,107,275 | 2/1938 | Anderson et al. | 34/23 |
| 2,799,096 | 7/1957 | Scott | 34/31 |
| 2,838,420 | 6/1958 | Valente | 34/23 |
| 2,981,528 | 4/1961 | Culp | 34/223 |
| 3,581,679 | 6/1971 | Jansen | 432/152 |
| 3,743,474 | 7/1973 | Brock | 432/8 |

*Primary Examiner*—John J. Camby
*Assistant Examiner*—Henry C. Yuen
*Attorney, Agent, or Firm*—Jones, Thomas & Askew

[57] ABSTRACT

A multiple stage oven for heating a product such as carpet or the like, which serially moves through each stage to be heated. Each stage of the oven includes a fuel burner for heating air within the stage, and a fan for recirculating the heated air in the stage for impingement onto a carpet product moving through the stage. A portion of the heated air within each stage is drawn from that stage and supplied to a serially preceding stage. The volume of air withdrawn from the last stage in the serial arrangement, and also the volume of make-up air admitted to the first stage thereof, does not exceed the sum of the fuel combustion products within the zones and any moisture or other substance evaporated or evolved from the carpet in each of the heating zones.

5 Claims, 3 Drawing Figures

MULTISTAGE PROGRESSIVE DRYING METHOD

This is a division of application Ser. No. 453,839, filed Mar. 22, 1974, now U.S. Pat. No. 3,923,449.

This invention relates in general to heating apparatus and in particular to a multiple stage oven for applying heat to a product such as carpet.

The commercial manufacture of carpet typically requires one or more drying or curing operations in which heat is applied to a carpet product. The carpet product is typically heated to remove moisture from a wet carpet product received from a preceding step in the manufacturing process, and/or to cure a material such as foamed backing applied to the carpet product. Typical ovens used for curing or drying consist of a number of individual heating zones through which the carpet is serially moved by a conveyor known as a tenter frame. Each heating zone typically includes a chamber where air is heated with a fuel burner, and air recirculation apparatus which moves the heated air for impingement onto the carpet product. Ovens used for curing a foamed backing material applied to a carpet product may be arranged to impinge heated air onto alternate sides of the carpet, in successive heating zones, since the heated air cannot flow through the foambacked carpet.

Each of the separate heating zones in carpet drying or curing ovens of the prior art is typically heated by a separate direct-fired burner which operates on a clean-burning fuel such as natural gas or propane. The air within each heating zone is typically heated to a temperature within the range of 300° F. to 450° F., depending on the carpet product and the backing material being cured, and these operating temperatures cannot readily or economically be provided by indirect heating. Each heating zone of the prior art carpet ovens has a separate exhaust fan to withdraw air, including combustion products and water evaporated from the carpet product, from the individual zone, and also has an inlet damper allowing ambient make-up air to enter the heating chamber of the zone. Each heating zone in known prior art carpet drying and curing ovens is completely independent of adjacent zones.

A typical prior art oven used for curing carpets consists of five individual heating zones, and typically from 3,000 to 6,000 cubic feet per minute (cfm) air is exhausted from each heating zone. This exhausted air must be vented outside of the building containing the oven, because of the moisture and the combustion products contained in the exhausted air, with a resulting total loss of the heat contained in the air exhausted from each of the individual heating zones. Moreover, it is apparent that the volume of air exhausted to atmosphere from each heating zone must be matched by an equal volume of make-up air supplied to the individual heating zones, and this make-up air is typically withdrawn directly from the heated ambient air within the building wherein the oven is situated. Carpet curing ovens, as a consequence, have a relatively low operating efficiency, with a typical operating efficiency being in the order of 33% of the fuel consumed by the oven burners. This low operating efficiency fails to account for the additional fuel required to heat the outdoor-air which must be supplied to the building to replace the make-up air drawn into the heating zones of the oven.

It has been proposed to improve the operating efficiency of carpet curing ovens by adding heat reclaimers to at least some of the individual heating zones, so that the heat in the air exhausted from each zone can be transferred by known techniques to preheat the make-up air being inducted into a heating zone of the oven. It has been found in actual practice that the operating efficiency of a five-zone carpet curing oven was increased from about 33% to about 38% by equipping three of the zones with heat reclaimers. The heat reclaiming apparatus is expensive to purchase and install, and the heat reclaimers are efficient only if cleaned and maintained daily.

The low operating efficiency of prior-art carpet ovens is expensive in the best of circumstances. Rising costs of natural gas and propane fuels, along with the scarcity of such fuels in many locations, places an even greater burden on the carpet manufacturer, and ultimately on the carpet purchaser.

Accordingly, it is an object of the present invention to provide an improved oven for heating a carpet product.

It is another object of the present invention to provide a carpet heating oven of improved operating efficiency.

It is yet another object of the present invention to provide a carpet heating oven which reduces the loss of heat in exhausted air.

Other objects and advantages of the present invention will become more readily apparent from the disclosed embodiment of the invention as set forth in the following description, including the drawing in which.

Stated in general terms, the oven of the present invention provides a number of heating zones through which a carpet product or other workpiece is serially moved to be heated, with the result that moisture is removed from the carpet product in the several heating zones. A limited volume of heated fluid, preferably substantially correponding to the volume of moisture removed from the carpet in the heating zone plus the volume of combustion products produced by burning fuel in the heating zone, is withdrawn from one of the heating zones and is supplied to a second one of the heating zones. Heated fluid corresponding in volume to the fluid supplied from the first heating zone plus the volume of combustion products and moisture removed from the carpet product in the second heating zone is withdrawn from the second heating zone and is supplied to a third heating zone. Heated fluid is similarly withdrawn from each remaining heating zone, other than a final one of such zones, and is transferred to another heating zone to provide a serial progression of fluid flow between heating zones. Heated fluid is exhausted to atmosphere only from a final one of the heating zones, and no more than the first one of the heating zones may need to receive make-up air supplied from outside the oven.

Figure 1:
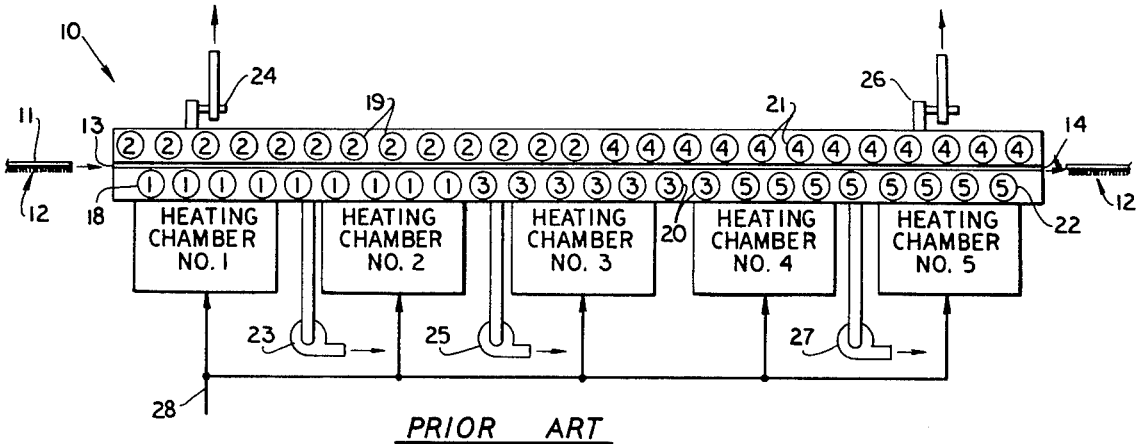
PRIOR ART FIG 1
FIG. 1 shows a schematic plan view of a prior art carpet oven.
Figure 2:
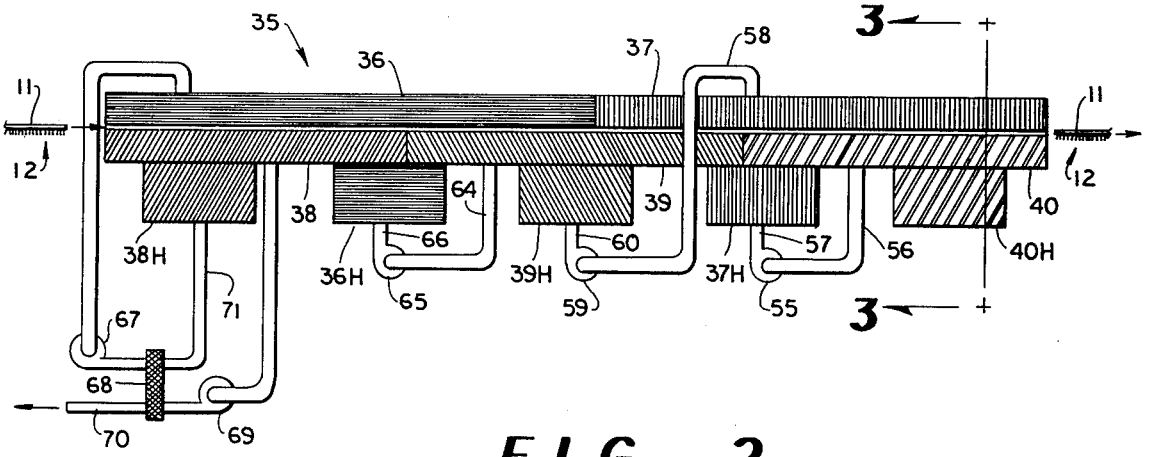
FIG. 2 shows a schematic plan view of a carpet curing oven according to the disclosed embodiment of the present invention.
Figure 3:
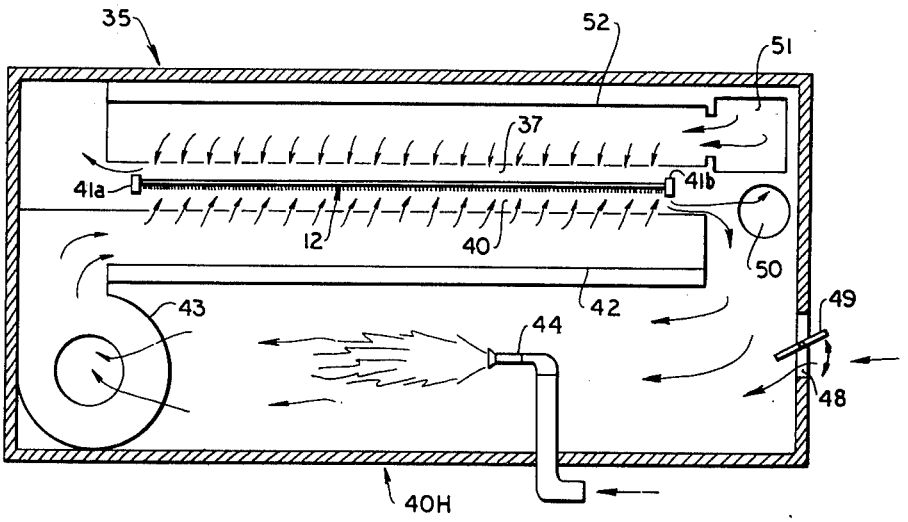
FIG. 3 is a section view taken along line 3—3 of FIG. 2.

The present invention is better understood with reference to FIGS. 2 and 3, wherein is depicted an illustrative embodiment of a carpet curing oven according to the present invention. As an aid in understanding the illustrative oven shown in FIGS. 2 and 3, there is shown in FIG. 1 a conventional prior art oven 10 which contains five separate heating zones and which is used, for example, for curing the latex backing material 11 which has been freshly applied to the carpet product 12. The carpet product 12 is carried by a tenter frame (not shown in FIG. 1) for support and movement through the oven 10 in a manner known to those skilled in the art. The carpet product 12 enters the inlet end 13 of the dryer, moves progressively through five separate heating zones, and exits the oven at the output end 14, from which the carpet product is conveyed to the next work station.

Since air or other heated fluid cannot flow through the latex-backed carpet product 12, an oven which is effective for curing such carpet product must direct heated fluid onto both sides of the carpet product passing through the dryer. Each of the five heating zones in the depicted conventional drying oven is provided with a number of conduits which receive heated fluid from one of multiple heating chambers; the conduits extend across the path of carpet travel to direct heated fluid onto a particular side of the carpet product moving through the oven. The reference numeral 18 in FIG. 1 designates examplary conduits connected to receive heated fluid from heating chamber 1 and directing the heated fluid against the carpet product 12 in zone 1 of the dryer. The conduits exemplified at 19 and containing the numeral 2 are connected to direct heated fluid from heating chamber 2 onto the carpet product in a second heating zone, while the conduits exemplified at 20, 21, and 22 are similarly associated with corresponding heating zones 3, 4, and 5, and are connected to receive heated fluid from corresponding heating chambers 3, 4, and 5. Heated fluid is directed against the downwardly-facing tufted side of the carpet product 12 in the heating zones 1, 3, and 5, while heated fluid is directed against the upwardly-facing latex backing material 11 in the heating zones 2 and 4. It is apparent from FIG. 1, however, that the total linear extent of heating zones 2 and 4 is substantially identical to the total linear extent of heating zones 1, 3, and 5, measured in the direction of travel of the carpet product through the oven 10.

Each of the heating chambers contains a fuel burner, appropriate fluid flow directing passageways connecting the heating chamber with the corresponding conduits that direct heated fluid against the carpet, and a recirculation fan for recirculating heated fluid in a closed path including the heating chamber, the corresponding conduits, and a portion of the carpet product and the carpet ducts. An appropriate fuel such as natural gas or propane is supplied in a line 28 to the burners of each heating chamber. Further details of each heating chamber are set forth below with respect to the disclosed apparatus shown in FIGS. 2 and 3.

Separate exhaust fans 23, 24, 25, 26, 27 are respectively connected to each of the heating zones 1 through 5. Each of the exhaust fans withdraws from the corresponding heating zone a mixture of heated fluid, including steam or water vapor evaporated from the carpet product and the combustion products of the fuel burner. Each of the five heating chambers has a suitable inlet opening to admit make-up air which is typically withdrawn from the atmosphere of the building in which the oven 10 is situated.

In a typical carpet curing oven of the prior art, as depicted in FIG. 1, from 3,000 to 6,000 cubic feet per minute (cfm) of heated fluid is exhausted from each of the heating zones by the corresponding exhaust fans, and the heat in the exhausted fluid is simply wasted. The exhausted fluid cannot simply be discharged within a building and must be vented to the outside atmosphere, as previously mentioned, and so additional energy is expended as needed to heat air introduced into the building to replace the make-up air required by the oven.

Turning now to FIGS. 2 and 3, there is shown an oven indicated generally at 35 and used for heating a carpet product for curing or drying purposes. The improved oven 35 is also divided into five separate heating zones, with two such zones 36 and 37 being on the upper side of the oven and with the remaining three zones 38, 39, and 40 being on the lower side thereof. Corresponding shading lines are used in FIG. 2 to denote the heating zones and associated heating chambers 36H, 37H, 38H, 39H, and 40H. Although the choice of five separate heating zones for the improved oven 35 is by way of example only, and is not limiting to the present invention, it will become apparent that the disclosed embodiment of the improved oven utilizes components such as conduits, fuel burners, and recirculating fans which are substantially similar to the corresponding components of the prior-art oven, so that an existing prior-art oven 10 can be modified or converted to an improved oven 35 through the application of the following teachings.

A typical cross-section view of the improved oven 35 is shown in FIG. 3, where the carpet product 12 is supported by the tenter frame 41*a* and 41*b* for movement in a direction out of the Figure. The carpet as shown in FIG. 3 is moving through heating zones 37 and 40. One of the transverse conduits of the heating zone 40 is shown at 42, and the conduit 42 is connected to receive a forced flow of heated fluid from the recirculating fan 43 located in heating chamber 40H situated below the heating zone 40. The heating chamber 40H also includes a fuel burner 44 connected to a suitable source of clean-burning fuel, such as natural gas or propane. The proper amount of air required for combustion of the fuel in the burner 44 is typically premixed with the fuel, externally of the oven, in a manner known to those skilled in the art. The heating chamber 40H is provided with a fluid inlet opening 48 having an appropriate damper valve 49 to adjust air flow in the opening. A fluid discharge opening 50 is provided at a suitable location in the heating chamber 40H.

Observing the fluid flow arrows depicted in FIG. 3 for the heating chamber 40H and the heating zone 40, it is seen that air heated by the burner 44 is forced by the recirculating fan 43 into the several conduits (one of which is shown at 42) associated with the heating zone 40. The heated air flows from the conduits, including the conduit 42, onto impingement with the lower side of the carpet product 12 passing through the oven, after which the suction effect of the recirculating fan 43 draws a portion of the impinging fluid (as well as any moisture which evaporated from the carpet product) away from the carpet product back to the burner 44 to be heated and recirculated. The remaining portion of the fluid is withdrawn into the fluid discharge opening 50, as discussed below. Heated fluid from the recirculating fan associated with the heating chamber 37H, meanwhile, is forced through the plenum 51 and the conduit 52 to impinge against the upper side of the carpet product 12 in the heating zone 37. It will be understood that a transverse cross-section view of each of the other four heating chambers of the improved oven apparatus 35 would show an arrangement of components substantially similar to that of FIG. 3.

The interrelationship of fluid flowing in a serial manner between the several heating zones of the improved oven apparatus 35 is shown in FIG. 2. A first exhaust fan 55 has an inlet duct 56 connected to the fluid discharge opening 50 of the heating zone 40. Fluid is withdrawn from the heating zone 40 by the first exhaust fan 55, and is supplied through the duct 57 to a fluid inlet opening in the heating chamber 37H, which supplies heated fluid to the heating zone 39. The duct 57 is connected to the heating chamber 37H at a fluid inlet opening similar to the opening 48 in the heating chamber 40H, shown in FIG. 3.

Heated fluid in the heating zone 37, including the fluid supplied from the preceding heating zone 40, is withdrawn from a discharge opening (similar to the opening 50 in the zone 40) by way of a duct 58, a second exhaust fan 59, and a duct 60 connected to a fluid inlet opening in the heating chamber 39H. Fluid is exhausted in a similar manner from the heating zone 39 by the duct 64, the third exhaust fan 65, and supplied to the heating chamber 36H by the duct 66.

Fluid is withdrawn from the heating zone 36 by the fourth exhaust fan 67 and is passed through a heat reclaimer 68 before being supplied through the duct 71 to a fluid inlet opening of the heating chamber 38H. Fluid in the heating zone 38 is withdrawn by the fifth exhaust fan 69 and is moved through the heat reclaimer 68 and subsequently supplied to the duct 70 to be dumped into the atmosphere. The heat reclaimer 68 is connected and operated to withdraw heat energy from the fluid exhausted from the heating zone 38, and to supply the withdrawn heat energy to the fluid flowing from the fourth exhaust fan 67 into oven 1. The use of a heat reclaimer as shown herein is optional, however, and is not an essential element of the progressive circulation system disclosed herein. The construction and operation of heat reclaimers are known to those skilled in the art.

It can be seen that the several separate heating zones of the improved oven apparatus 35 are connected in a serial fluid flow circuit. The fluid exhausted from the fifth zone 40 is the sole supply of make-up fluid for the fourth zone 37, the fluid exhausted from the fourth zone is the sole source of make-up fluid for the third zone 39, and so on. Only the exhaust from the first zone 38 is withdrawn from the oven and discharged to atmosphere, and some of the heat remaining in the first-zone exhaust can be reclaimed and returned to a heating zone of the oven. Make-up air from outside the oven 35 is introduced only into the fifth zone, i.e., the final zone in the serial arrangement. The fluid discharged to atmosphere from the oven is preferably withdrawn from the heating zone which first receives the moving carpet product 12, especially where the carpet product contains moisture to be removed by the oven, since the carpet product generally will lose more moisture in such first zone than in any one of the subsequent heating zones.

The improved oven apparatus 35 according to the present invention is most efficiently operated with a minimum volume of fluid withdrawn from each of the heating zones of the oven. The minimum volume of exhaust fluid which should be withdrawn from a particular heating zone is determined by the volume of water being removed from the carpet product by evaporation in the heating zone plus the volume of combustion products generated by the heating chamber associted with the heating zone, when the oven 35 is operating at maximum capacity, plus any volume of fluid received from a preceding heating zone. The minimum volume of fluid which should be exhausted from the final heating zone in the serial fluid flow arrangement (zone 38, in the disclosed embodiment of the invention) is the sum of the volumes of moisture removed from the carpet product in each heating zone plus the sum of the combustion products from each heating zone. Of course, more than the minimum volume of fluid can be withdrawn from the oven, if desired, although a corresponding additional heat loss will be incurred. It will also be understood that a volume of external make-up air must be admitted to the initial zone of the oven (zone 40, in the disclosed embodiment) if more than the minimum volume of fluid is withdrawn from the oven.

In an actual application of the present invention to a five-zone oven used for curing latex backing previously applied to a carpet product, the overall average volume of fluid exhausted from the oven was reduced from 20,000 cfm, before application of the present invention, to 4,000 cfm when the oven was modified to conform with the present invention. When used for curing a latex backing containing 30% water on a carpet product moving through the oven at 25 feet per minute, the energy loss resulting from heat in air exhausted from the oven was reduced from an estimated 4,280,000 BTU per hour to approximately 750,000 BTU per hour. A corresponding substantial reduction in the required consumption of natural gas, the fuel used to fire the burners of the particular oven, was also observed. An additional energy reduction resulted from reducing the volume of make-up air withdrawn from the heated air within the building housing the oven. It is estimated that the specific actual embodiment of improved oven reduced the building heat load by about 1,500,000 BTU per hour, assuming outside air at 0° F.

Although the illustrative embodiment of the present invention depicted in FIGS. 2 and 3 establishes serial flow between heating zones through the use of ducts and fans located externally of the various heating zones and heating chambers, the depicted external arrangement of components is only illustrative and the present invention is not limited to the use of such ducts and other external components to establish serial flow of fluid from a final heating zone back to an initial heating zone. The serial fluid flow required for the practice of the present invention can alternatively be provided through appropriate fluid flow passages and fluid pressure differentials created entirely within the oven apparatus.

It will also be understood that the foregoing relates only to a preferred embodiment of the present invention, and that numerous alterations and modifications may be made therein without departing from the spirit and the scope of the invention as set forth in the following claims.

What is claimed is:

1. Method of heating a carpet product to remove moisture therefrom, while serially passing the carpet product through a plurality of heating zones so that the carpet product initially passes through a first heating zone and subsequently passes through a second heating zone, comprising the steps of:

subjecting the carpet product to heated fluid within each of said plural heating zones, so that moisture associated with the carpet product passing through a heating zone is at least partially removed by evaporation from the carpet product within the heating zone;

withdrawing a first volume of fluid from only said first heating zone and exhausting said withdrawn fluid to atmosphere without any further moisture removing exposure of the withdrawn fluid to the carpet product;

supplying said first heating zone with a volume of make-up fluid which is withdrawn only from said second one of said plural heating zones and which is substantially equal in volume to said first volume less the volume of moisture removed from the carpet product within said first zone; and admitting make-up fluid from a source external to all of said heating zones, to only the last of said plural heating zone through which the carpet product passes.

2. The method as in claim 1, in which said first volume of fluid withdrawn from said first heating zone is at least as great as the total volume of the moisture removed from the carpet product in each of said heating zones.

3. The method as in claim 1, wherein: each of said plural heating zones, except for a certain heating zone, is supplied seriatim with a volume of fluid withdrawn seriatim from another of said heating zones; and the volume of fluid withdrawn from each individual heating zone, excluding said certain heating zone, is substantially the volume of moisture removed from the carpet product within the individual heating zone plus the volume of fluid supplied seriatim to the individual heating zone from another of said heating zones.

4. The method as in claim 3, further comprising:

burning a fuel-air mixture within at least some of said plural heating zones to provide heated fluid for heating the carpet product; and withdrawing from said first heating zone a volume of fluid at least equal to the volume of moisture removed from the carpet product in all of said plural heating zones and the volume of combustion products resulting from burning said fuel-air mixture in said heating zones.

5. The method of progressively removing moisture from a carpet product serially moving through a plurality of separate heating zones, comprising the steps of:

directing a stream of heated fluid onto at least one side of the carpet product passing through each respective heating zone, to remove fluid by evaporation from the carpet product in each heating zone;

withdrawing fluid to atmosphere only from the said heating zone through which the carpet product initially passes;

permitting each of said heating zones, except for the final one of the heating zones through which the carpet product passes, to receive make-up fluid only from a serially subsequent heating zone; and admitting make-up fluid to said final heating zone from a source external to all of said heating zones.

* * * * *